US008511850B2

(12) United States Patent
Hawkins et al.

(10) Patent No.: US 8,511,850 B2
(45) Date of Patent: Aug. 20, 2013

(54) SEALED UNIBODY-REFLECTOR LUMINAIRE

(75) Inventors: James W. Hawkins, Lake Bluff, IL (US); Kevin S. Dahlen, Lindenhurst, IL (US); Brandon A. Stolte, Lindenhurst, IL (US); Bradford T. Wilson, Twin Lakes, WI (US)

(73) Assignee: Kenall Manufacturing, Gurnee, IL (US)

( * ) Notice: Subject to any disclaimer, the term of this patent is extended or adjusted under 35 U.S.C. 154(b) by 220 days.

(21) Appl. No.: 13/106,443

(22) Filed: May 12, 2011

(65) Prior Publication Data

US 2012/0120645 A1 May 17, 2012

Related U.S. Application Data

(60) Provisional application No. 61/333,826, filed on May 12, 2010.

(51) Int. Cl.
*F21V 7/00* (2006.01)

(52) U.S. Cl.
USPC ..... 362/225; 362/217.05; 362/223; 362/267; 362/364

(58) Field of Classification Search
USPC ..... 362/217.05, 223, 225, 267, 364, 362/365
See application file for complete search history.

(56) References Cited

U.S. PATENT DOCUMENTS

| | | | | |
|---|---|---|---|---|
| 4,323,954 | A | 4/1982 | Florence et al. | |
| 5,172,976 | A | 12/1992 | Bogdanovs | |
| 5,902,035 | A | 5/1999 | Mui | |
| 5,997,158 | A | 12/1999 | Fischer et al. | |
| 6,962,425 | B1 * | 11/2005 | Rhee | 362/267 |
| 6,984,055 | B2 | 1/2006 | McCarthy et al. | |
| D564,694 | S | 3/2008 | Southern, Jr. | |
| 7,387,410 | B2 | 6/2008 | Sibout | |
| 7,431,473 | B2 | 10/2008 | Wilson et al. | |
| 7,494,241 | B2 | 2/2009 | McCarthy et al. | |
| 7,674,005 | B2 * | 3/2010 | Chung et al. | 362/223 |
| 7,686,484 | B2 | 3/2010 | Heiking et al. | |
| 7,815,327 | B2 | 10/2010 | Shamshoian | |
| 7,963,662 | B2 | 6/2011 | Chung et al. | |
| 2007/0247850 | A1 | 10/2007 | Hawkins et al. | |
| 2009/0072745 | A1 | 3/2009 | Hawkins et al. | |
| 2009/0196023 | A1 | 8/2009 | Heiking et al. | |
| 2010/0053947 | A1 * | 3/2010 | Fowler et al. | 362/223 |
| 2011/0211343 | A1 * | 9/2011 | Chung et al. | 362/223 |

* cited by examiner

*Primary Examiner* — Stephen F Husar
*Assistant Examiner* — James Cranson, Jr.
(74) *Attorney, Agent, or Firm* — Jansson Munger McKinley & Shape Ltd.

(57) ABSTRACT

In a sealed recessed lighting fixture having a housing forming a ceiling-alignment plane and a light-emitting opening, at least one elongate lamp mounted to and within the housing and defining a fixture direction, at least one reflector surface parallel to the fixture direction, and a lens, the improvement wherein the at least one reflector surface is/are part(s) of a unibody-reflector assembly which includes: (a) two reflector sections terminating in longitudinal inner edges forming a gap therebetween; (b) a distal edge perimetrically along the light-emitting opening of the housing; (c) a seal between the distal edge and the housing at the opening; (d) two opposed substantially parallel endwalls each having a lens-engaging proximal edge; (e) the lens being an elongate shaped member terminating at opposite lens ends, the lens enveloping the at least one lamp and being of substantially constant cross-section along its length, whereby the unibody-reflector assembly is removable from the housing as a single unit to expose the lamp(s) in the housing for service.

17 Claims, 16 Drawing Sheets

SEALED UNIBODY-REFLECTOR LUMINAIRE

RELATED APPLICATION

This application claims the benefit of U.S. Provisional Application No. 61/333,826 filed on May 12, 2010, the contents of which is incorporated by reference herein in its entirety.

FIELD OF THE INVENTION

This invention is related generally to lighting technology. More particularly, the invention relates to the field of sealed lighting fixtures for use in environments in which contamination of objects in a room must be controlled.

BACKGROUND OF THE INVENTION

Many luminaires (or lighting fixtures) are placed in recessed applications in which contamination is transmitted through the air. In such cases, luminaires that are sealed from the environment are preferred, and in some cases, mandated by various regulatory bodies. In the past however, lighting fixtures of this type have a number of negative performance characteristics among which are undesirable lens reflections and unsightly gaps in the light paths. All of these functional shortfalls further are accompanied by less-than-desirable aesthetics.

The terms "luminaire" and "lighting fixture" are used interchangeably in this document.

OBJECTS OF THE INVENTION

It is an object of the present invention to provide a luminaire which is sealed from contamination and from penetration by liquids such as water.

Another object of the present invention is to provide a sealed luminaire that does not incorporate a door.

Another object of the present invention is to provide a sealed luminaire having a unibody-reflector assembly which can be easily removed for servicing and cleaning.

Another object of the present invention is to provide a luminaire which hides the ends of the fluorescent tubes.

Another object of the present invention is to provide a sealed luminaire which can be used with several different types of light sources.

Yet another object of the present invention is to provide a sealed luminaire which has an aesthetic appearance of a so-called architectural lighting fixture.

These and other objects of the invention will be apparent from the following descriptions and from the drawings.

SUMMARY OF THE INVENTION

The term "luminaire" is used interchangeably with the terms "lighting fixture" and "fixture" in this document.

A sealed recessed lighting fixture having a housing forming a ceiling-alignment plane and a light-emitting opening is provided. The sealed recessed lighting fixture includes at least one elongate lamp mounted to and within the housing and defining a fixture direction. The sealed recessed lighting fixture includes at least one reflector surface parallel to the fixture direction, and a lens. The reflector surface is/are part(s) of a unibody-reflector assembly. The unibody-reflector assembly includes two reflector sections terminating in longitudinal inner edges forming a gap therebetween, a distal edge perimetrically along the light-emitting opening of the housing, a seal between the distal edge and the housing at the opening, two opposed substantially parallel endwalls each having a lens-engaging proximal edge. The lens may be an elongate shaped member terminating at opposite lens ends, the lens enveloping the at least one lamp and being of substantially constant cross-section along its length. The unibody-reflector assembly is removable from the housing as a single unit to expose the lamp(s) in the housing for service. The sealed recessed lighting fixture also includes a pair of endcaps each engaged with a respective one of the endwalls. Each lens end may be in sealed engagement with a respective one of the endcaps and may extend beyond a corresponding endwall and the lens-engaging proximal edges are complementary to the lens cross-section.

The sealed recessed lighting fixture may also include a lens that has an arcuate light-transmissive central portion facing the light-emitting opening and two longitudinal edge portions each in sealing engagement with a respective reflector section inner edge. The lens may also have an arcuate light-transmissive central portion facing the light-emitting opening, two inwardly-turned light-transmissive side portions therealong, and two longitudinal edge portions each in sealing engagement with a respective reflector section inner edge. At least one lamp of the sealed recessed lighting fixture is a fluorescent tube substantially centered along the gap. The lamp may also be a plurality of fluorescent tubes.

The sealed recessed lighting fixture may include a housing forming a ceiling-alignment plane and a light-emitting opening, at least one lamp mounted to and within the housing, at least one reflector surface of substantially constant cross-section along its length which defines a fixture direction, and a lens. The sealed recessed lighting fixture may include at least one reflector surface which is/are part(s) of a unibody-reflector assembly. The unibody-reflector assembly includes two reflector sections terminating in longitudinal inner edges forming a gap therebetween, a distal edge perimetrically along the light-emitting opening of the housing, a seal between the distal edge and the housing at the opening, two opposed substantially parallel endwalls each having a lens-engaging proximal edge. The sealed recessed lighting fixture includes a lens being an elongate shaped member terminating at opposite lens ends, the lens enveloping the lamp(s) and being of substantially constant cross-section along its length. The sealed recessed lighting fixture includes a unibody-reflector assembly that is removable from the housing as a single unit to expose the lamp(s) in the housing for service.

The sealed recessed lighting fixture may also include a pair of endcaps each engaged with a respective one of the endwalls. Each lens end may be in sealed engagement with a respective one of the endcaps. Each lens end may extend beyond a corresponding endwall. The proximal lens-engaging edges are complementary to the lens cross-section. The lens has an arcuate light-transmissive central portion facing the light-emitting opening, two inwardly-turned light-transmissive side portions therealong, and two longitudinal edge portions each in sealing engagement with a respective reflector section inner edge.

The sealed recessed lighting fixture may include at least one lamp which includes at least one LED module. The lamp may be an elongate lamp parallel to the fixture direction and may be a fluorescent tube or a plurality of fluorescent tubes.

BRIEF DESCRIPTION OF THE DRAWINGS

In order that the advantages of the invention will be readily understood, a more detailed description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF PREFERRED EMBODIMENTS

The figures illustrate several embodiments of the present invention. Numerous figures are photographs and drawings of such embodiments showing various views and details. One skilled in the art will recognize, however, that the invention may be practiced without one or more of the specific details, or with other methods, components, materials, and the like. In other instances, well-known structures, materials, or operations are not shown or described in detail to avoid obscuring aspects of the invention.

Figure 1:
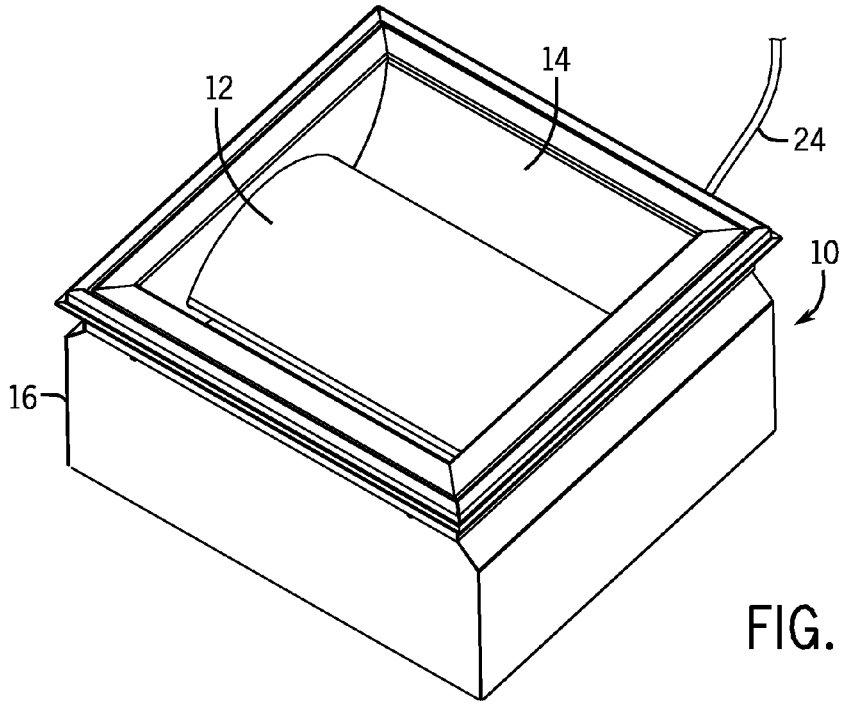
FIG. 1 is a photograph of one embodiment of a fully-assembled inventive unibody-reflector luminaire.
Figure 2:
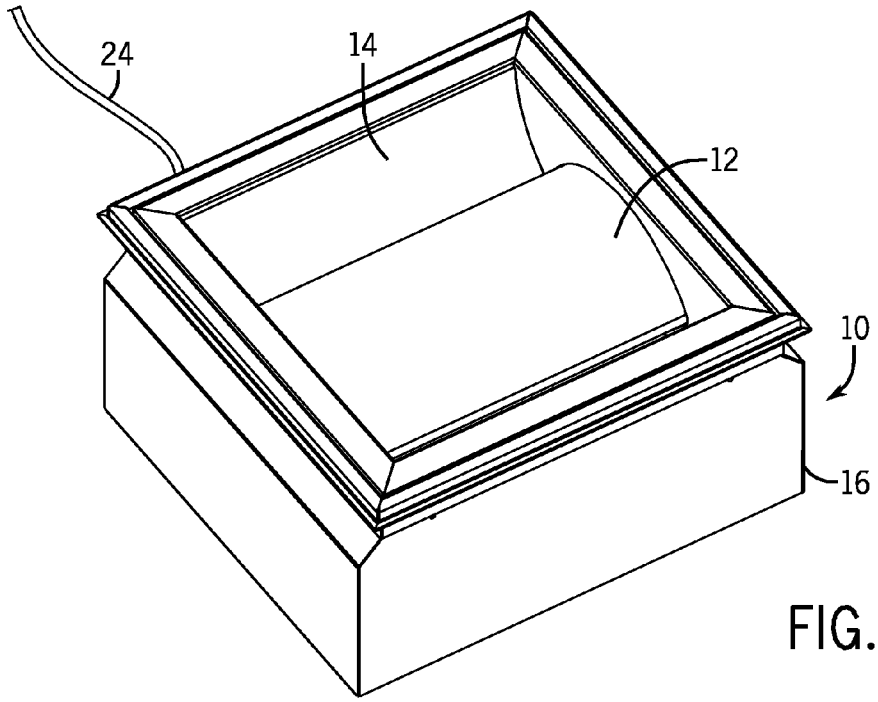
FIGS. 2 and 3 are additional photographs of the luminaire of FIG. 1.
Figure 3:
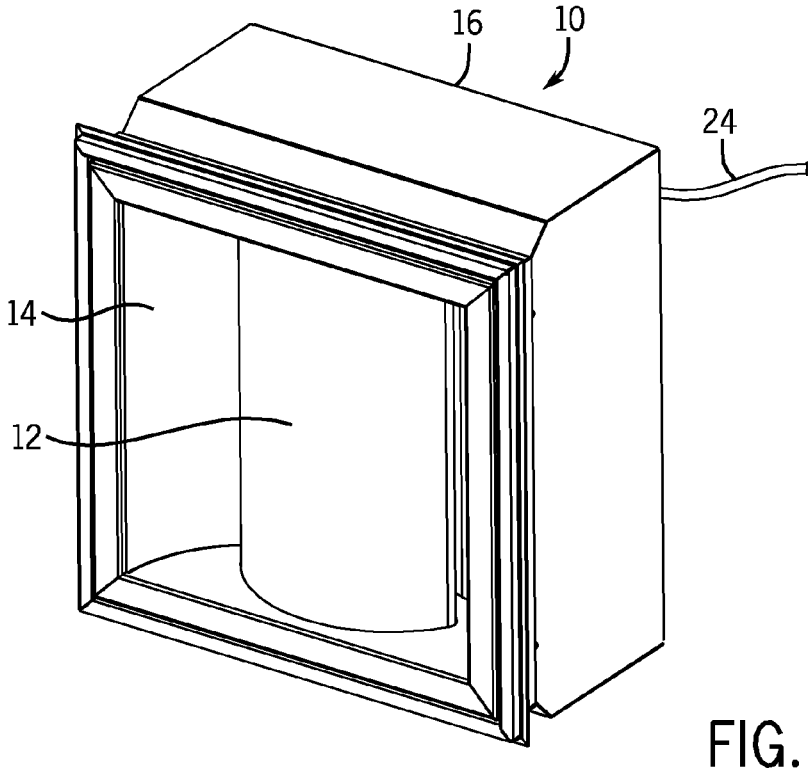
Figure 4:
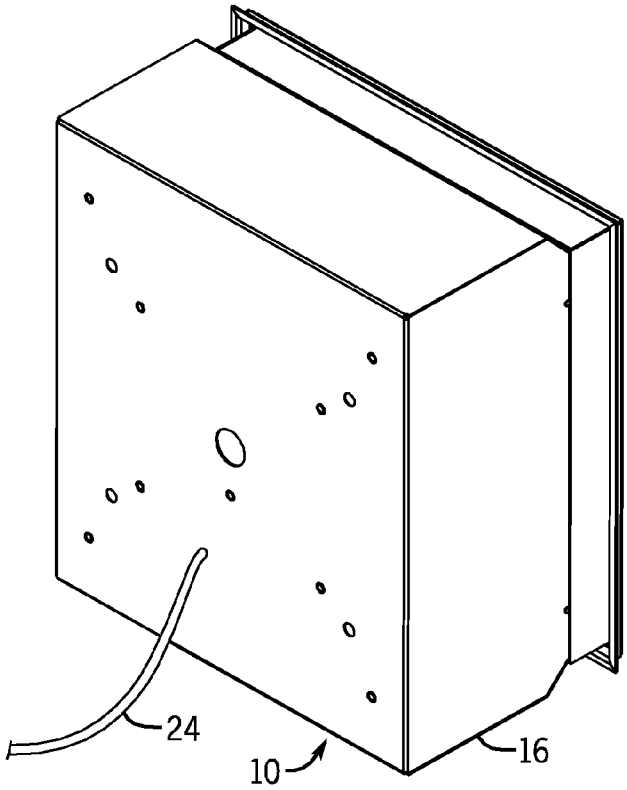
FIG. 4 is another photograph of the luminaire of FIG. 1, taken form the back or underside of the luminaire.
Figure 5:
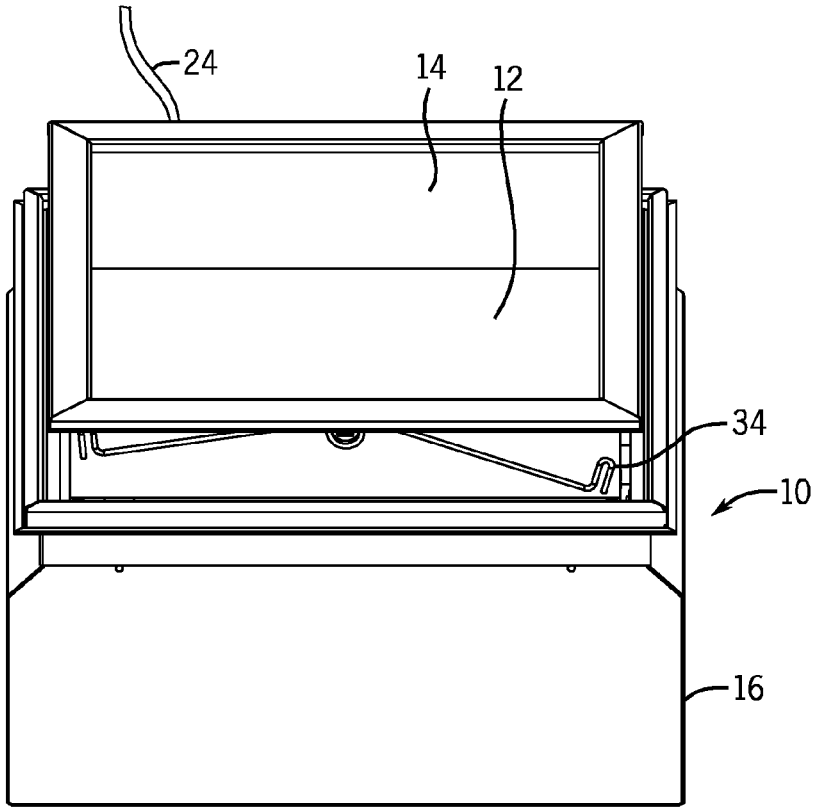
FIG. 5 is another photograph of the luminaire of FIG. 1, with the unibody-reflector assembly partially lifted to show one torsion spring used to assemble the unibody reflector to the housing.
Figure 6:
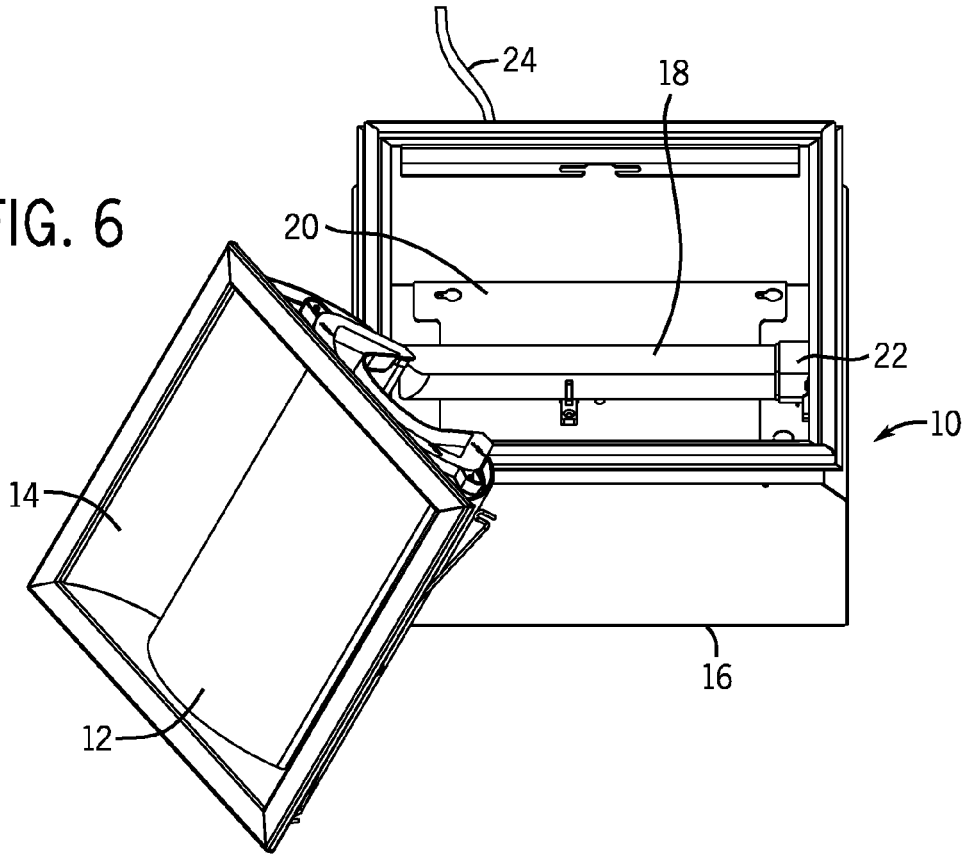
FIG. 6 is a another photograph of the luminaire of FIG. 1, with the unibody-reflector assembly removed from the housing.
Figure 7:
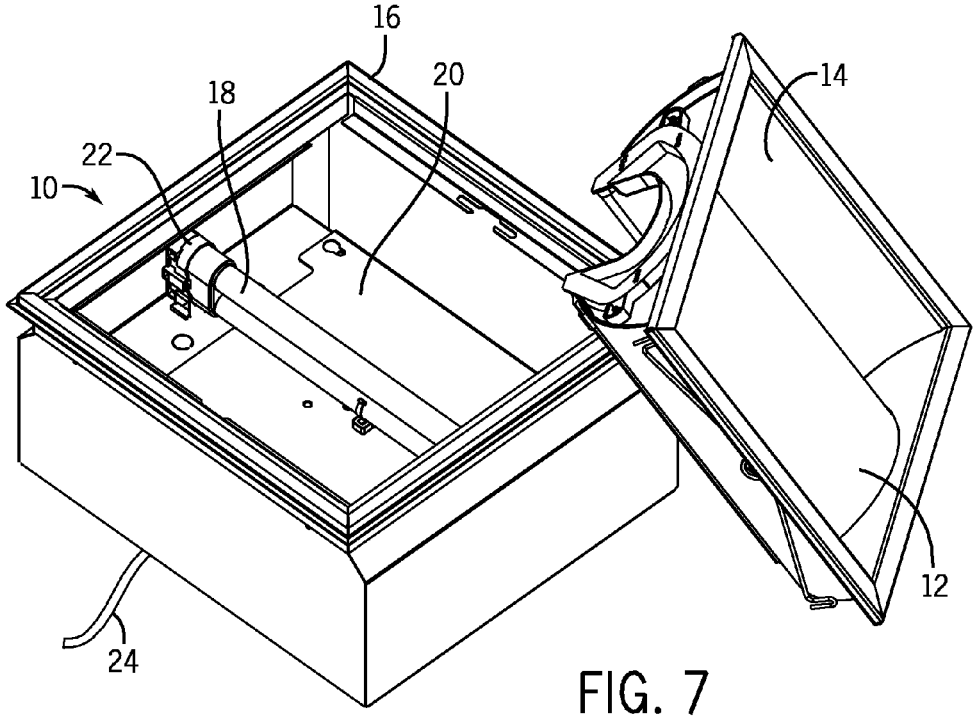
FIGS. 7-10 are four additional photographs of the luminaire of FIG. 1, with the unibody-reflector assembly removed from the housing.
Figure 8:
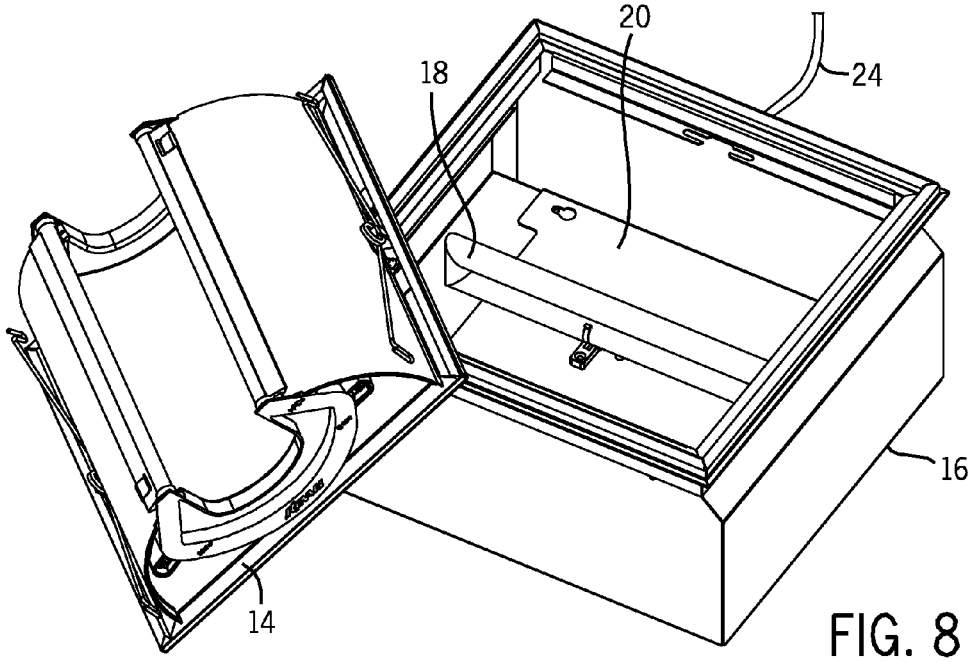
Figure 9:
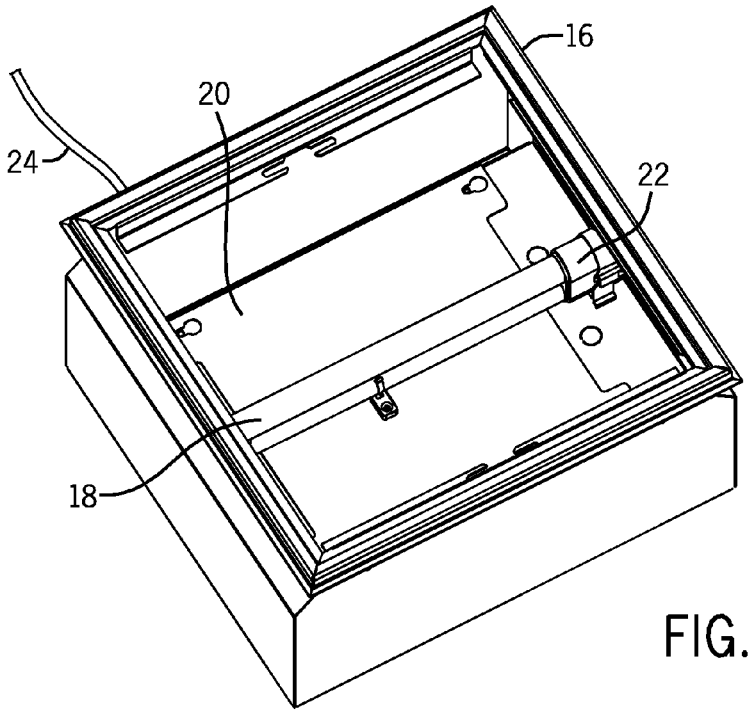
Figure 10:
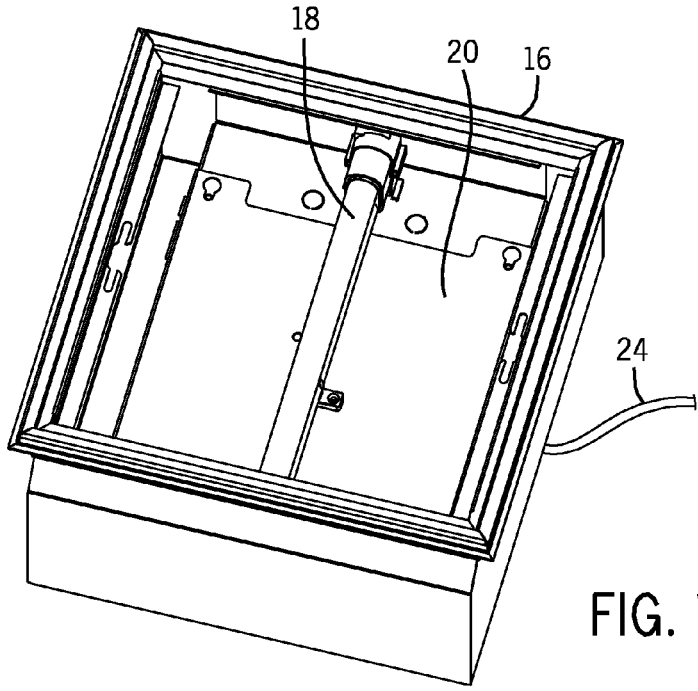
Figure 11:
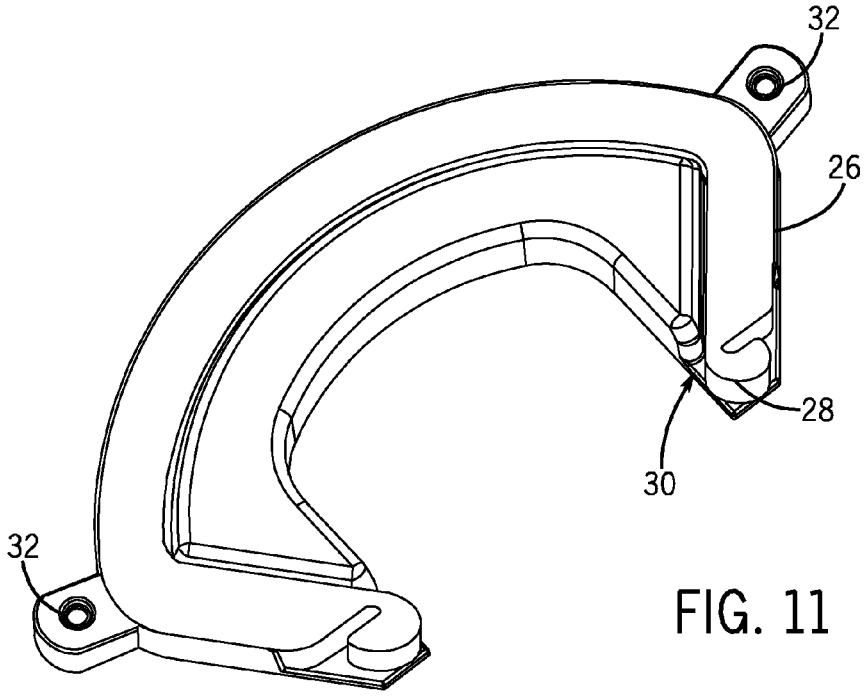
FIG. 11 is a photograph of a lens endcap of a unibody-reflector assembly, taken from the lens side of the endcap and showing a gasket seal.
Figure 12:
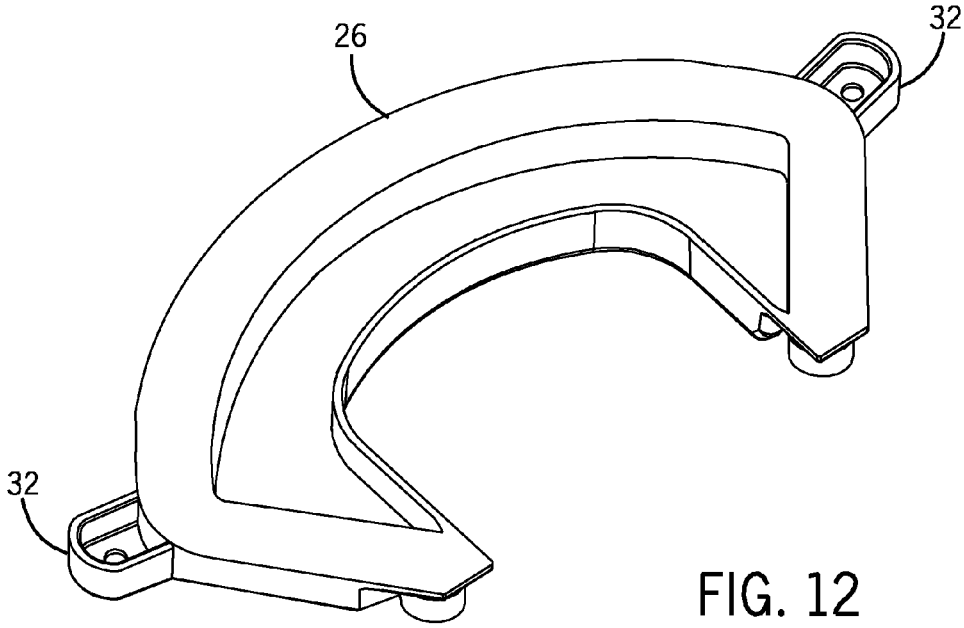
FIG. 12 is a photograph of a lens endcap of a unibody-reflector assembly, taken from the outer side of the endcap.

FIGS. 1-19 show a preferred embodiment of the sealed recessed lighting fixture incorporating the unibody-reflector assembly. As can be seen, luminaire 10 includes a diffusing lens 12, reflector 14 and housing 16. As illustrated in FIGS. 6-10, lamp 18 in included within housing 16 having back plate 20. Lamp 18 is held in position and connected electrically to the luminaire by lamp holder 22. Connecting cord 24 may connect the luminaire to a standard AC power source or other required power based on application and installation requirements. FIGS. 11 and 12 illustrate the details of the endcap 26 having a gasket 28 positioned within channel 30. Endcap 26 is of a contour corresponding to the outline of diffusing lens 12 and includes several fastening points 32.

Figure 16:
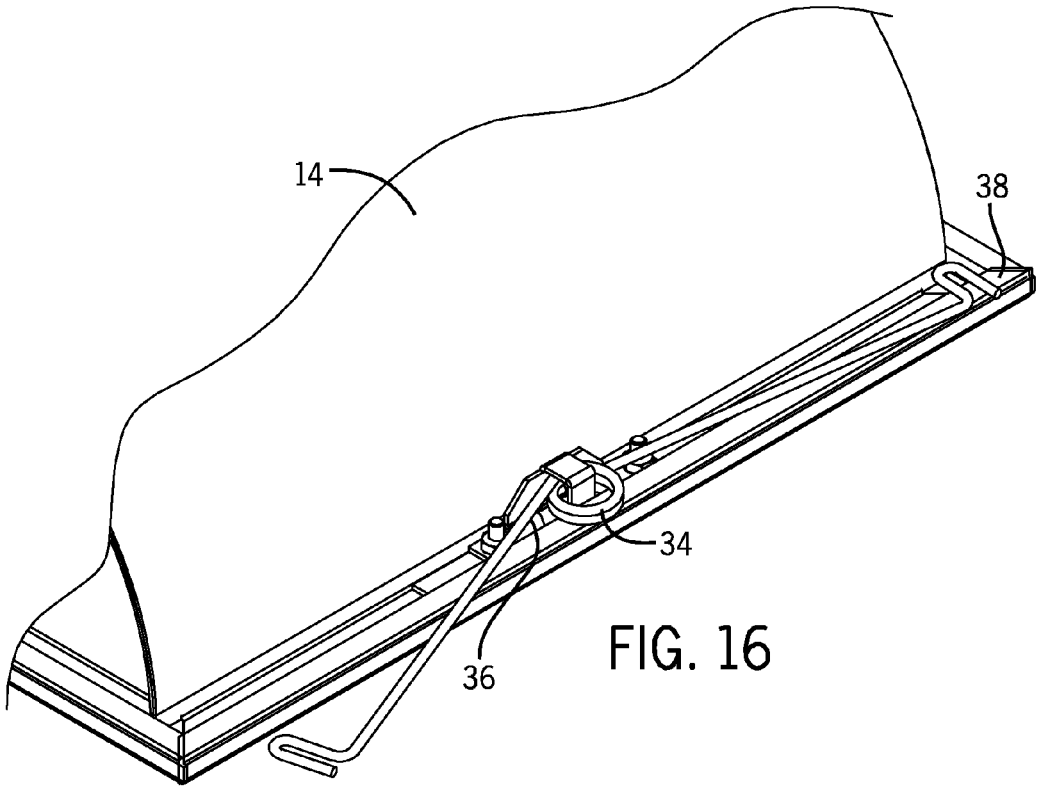
FIG. 16 is a closed-up photograph of a torsion spring used to assemble the unibody-reflector assembly to the housing.
Figure 17:
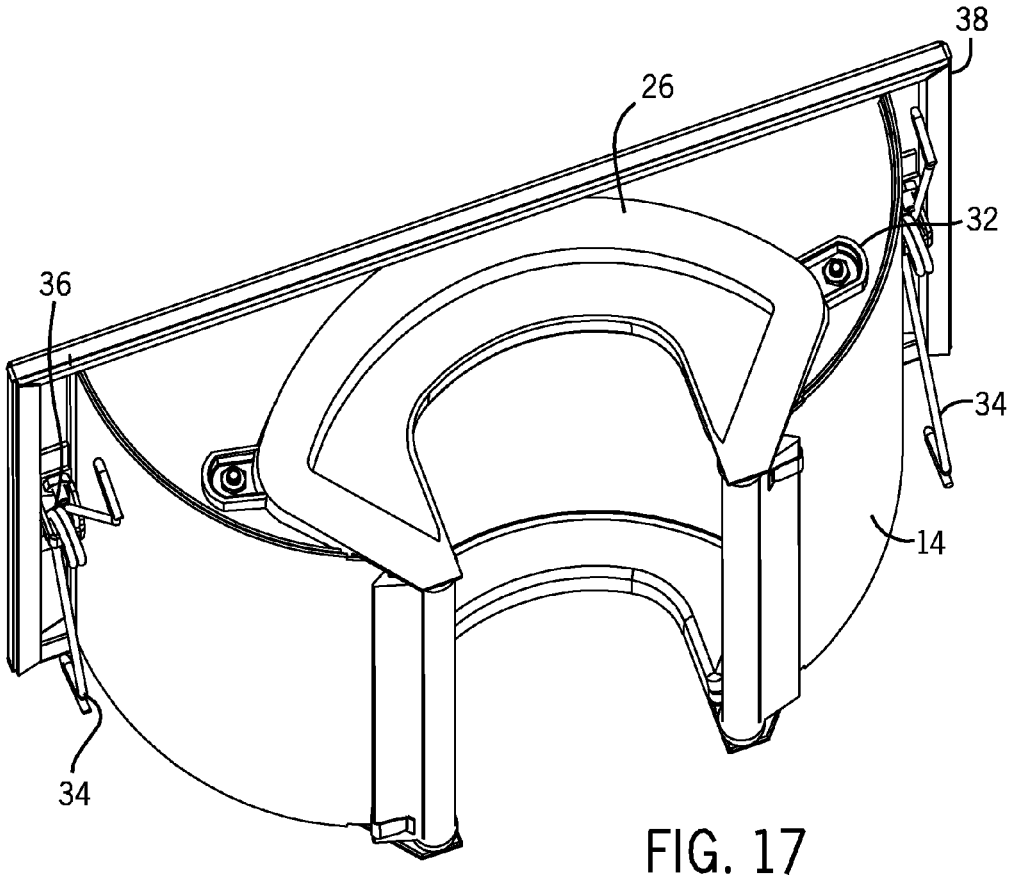
FIG. 17 is a photograph of the unibody-reflector assembly of the luminaire of FIG. 1.
Figure 18:
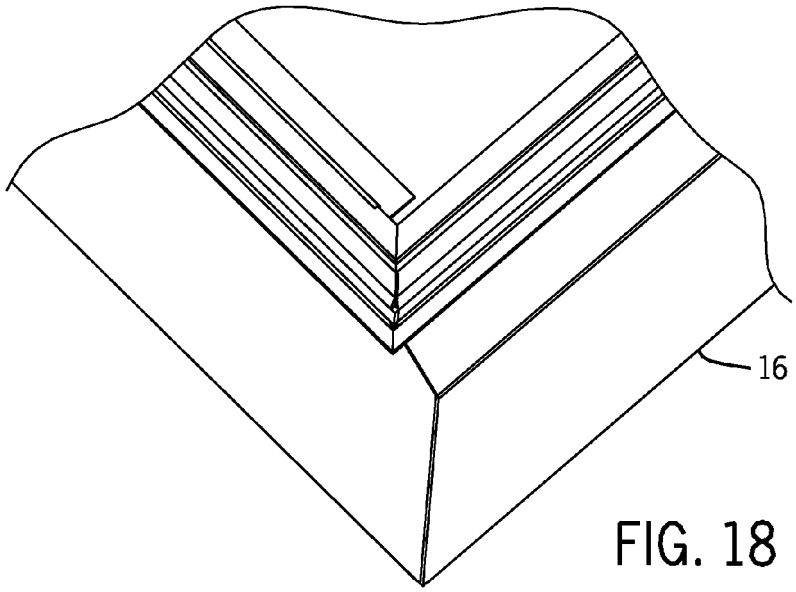
FIG. 18 is a close-up photograph of a corner of the housing of the luminaire of FIG. 1.
Figure 19:
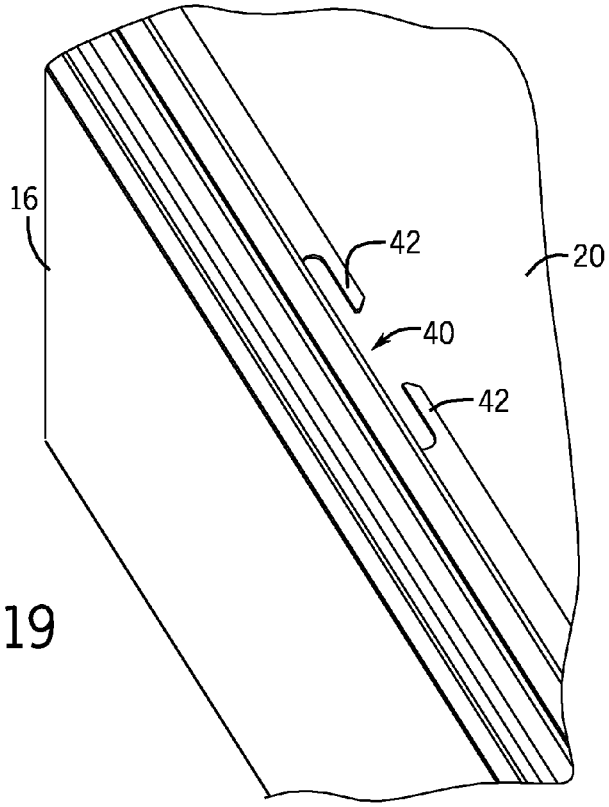
FIG. 19 is a close-up photograph of one edge of the housing of the luminaire of FIG. 1 showing one pair of slots for a torsion spring.

As seen in FIGS. 16 and 17, reflector 14 includes torsion spring 34 for securing reflector 14 to housing 16. Torsion spring 34 is connected at connection point 36 on reflector 14. Gasket 38 is included around the perimeter of reflector 14 to assist in sealing reflector 14 to housing 16. As shown in FIG. 19, torsion spring 34 engages housing 16 at slot 40. Slot 40 includes retaining fingers 42 to grab and hold torsion spring 34 in place on housing 16.

One embodiment of the inventive lighting fixture includes several components which are made of steel, such as the housing and the reflectors, endwalls and distal edge of the unibody-reflector assembly. Another embodiment of the inventive light fixture is a non-ferrous embodiment for use, for example, within an MRI room. In such an embodiment, all magnetic components are replaced with non-magnetic components. In such an embodiment, the housing, reflectors, endwalls and distal edge may be made of aluminum, and the torsion springs may be made of a non-magnetic stainless steel alloy.

In some embodiments, fluorescent lamps may be used, such as T5, T8 or biaxial fluorescent tubes. In one preferred embodiment, biaxial lamp 18 is shown in the lighting fixture of FIGS. 6-10. In other embodiments, other light sources such as LED modules may be used. Any type of light sources which can mounted within such housings, including but not limited to, incandescent lamps, may also be used.

Figure 20:
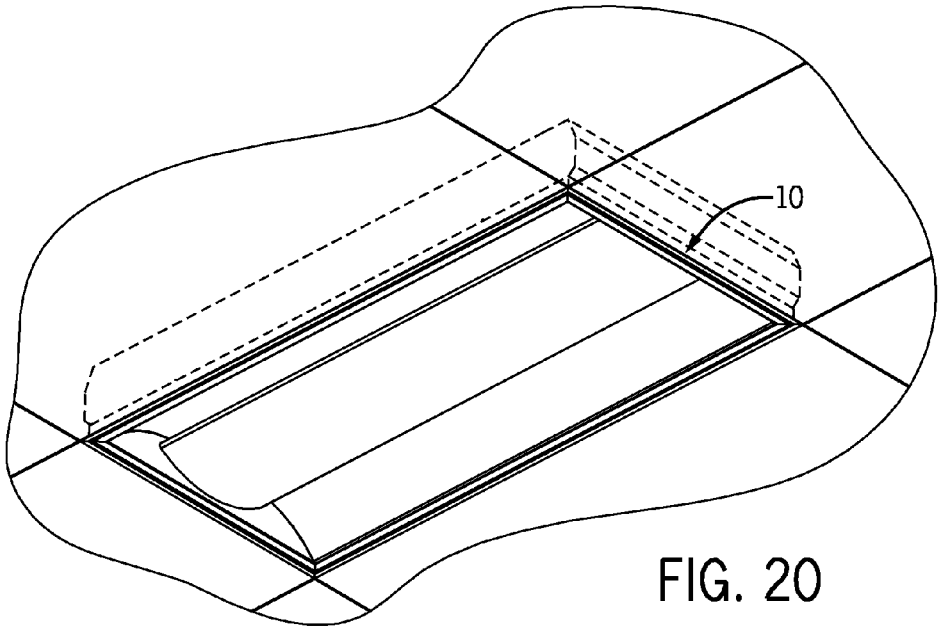
FIG. 20 is a photograph of a 2×4-foot embodiment of the inventive unibody-reflector luminaire installed in a grid ceiling system.

FIG. 20 shows an additional embodiment of the sealed recessed lighting fixture incorporating the unibody-reflector assembly 10 of FIGS. 1-19, particularly shown with greater length and width than the luminaire of FIGS. 1-19. FIGS. 21-24 show interior details of the sealed recessed lighting fixture incorporating the unibody-reflector assembly. Corresponding elements are numbered consistently across FIGS. 1-28.

Figure 21:
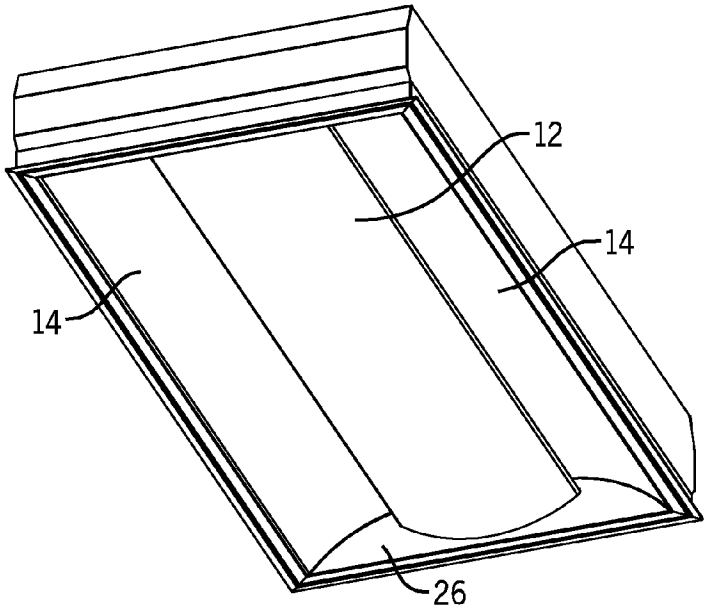
FIG. 21 is a perspective drawing of an embodiment of a fully-assembled inventive unibody-reflector luminaire.
Figure 21A:
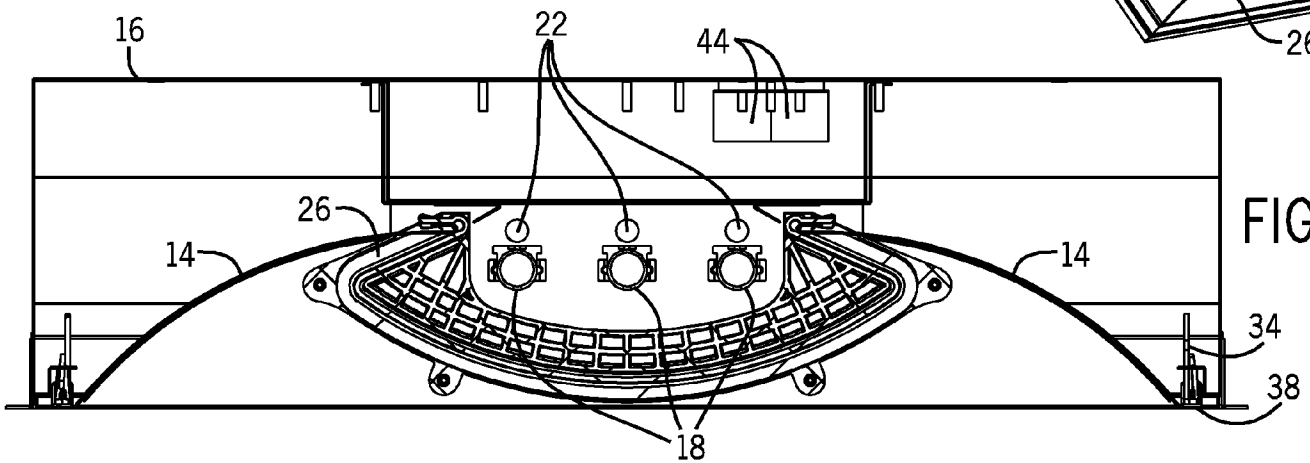
FIG. 21A is an endview elevation of the luminaire of FIG. 21.

FIG. 21 is a perspective drawing of an embodiment of a fully-assembled sealed recessed lighting fixture incorporating the unibody-reflector assembly 10. Lamps 18 shown in this embodiment are fluorescent T5 lamps (see FIG. 21A). The lamps are controlled by ballast 44

Figure 22:
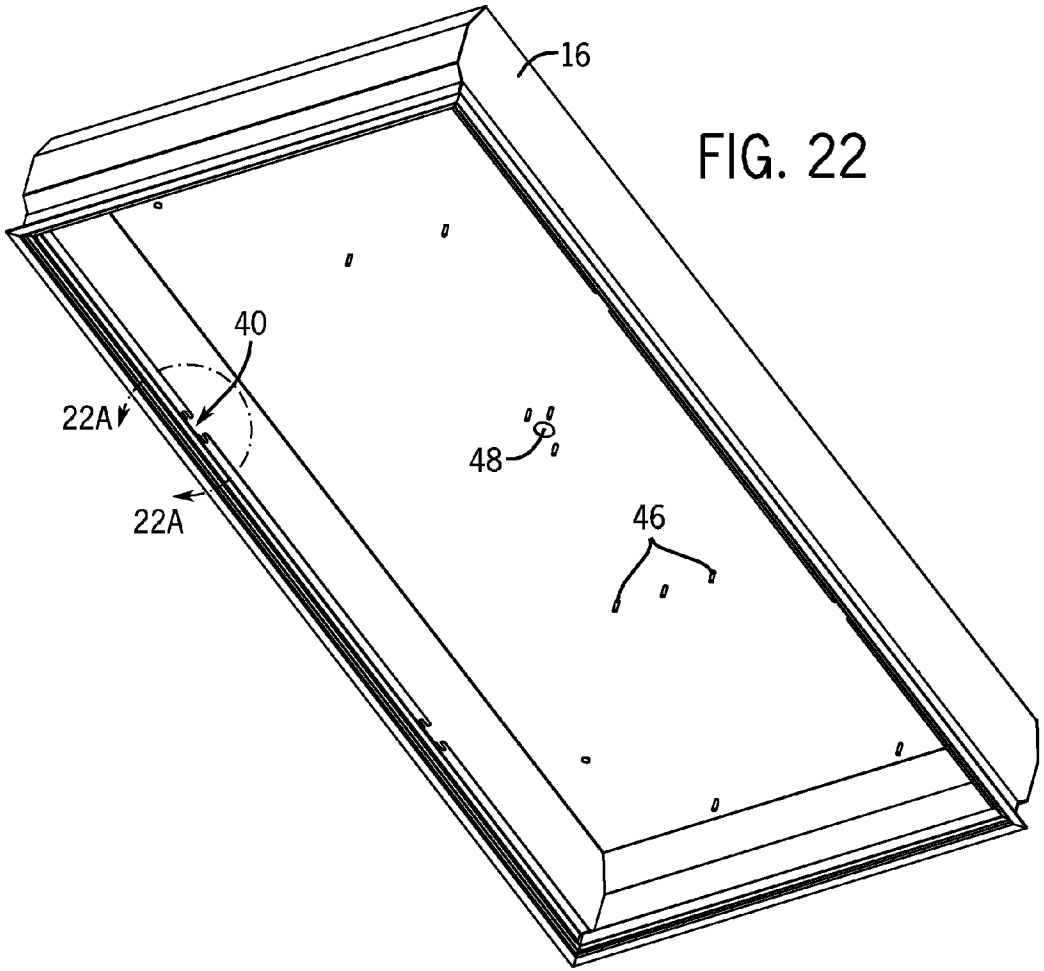
FIG. 22 is a perspective drawing of the housing of the luminaire of FIG. 21.
Figure 22A:
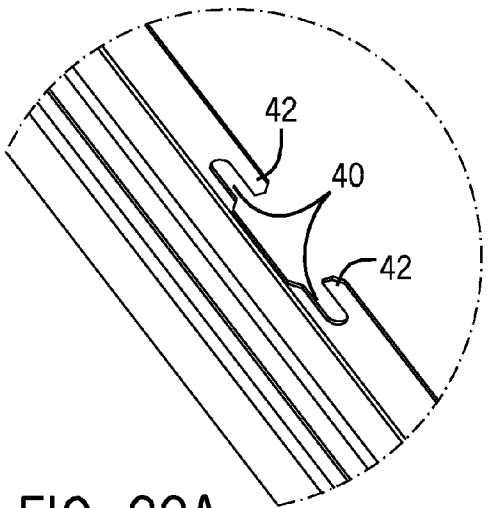
FIG. 22A is a detailed perspective drawing of the indicated region B of FIG. 22, showing one pair of slots for a torsion spring.

FIG. 22 is a perspective drawing of the housing 16 of the luminaire 10 of FIG. 21. The housing 16 shown in FIG. 22 includes a number of clinch studs 46 which are included to assist in the mounting of components to housing 16. Wiring access is provided by apertures 48 in housing 16. As noted above, housing 16 also includes slots 40 on each longer side of housing 16. Slots 40 (open-ended slots for easier use) are configured to receive torsion springs 34 mounted on the unibody-reflector assembly to hold the assembly in a sealed relationship with housing 16. FIG. 22A shows the detail of one such pair of slots.

In an embodiment of the inventive lighting fixture utilizing ferrous materials, the housing may be made of sheet steel. The housing structure may be of continuous-seam-welded construction.

Figure 23:
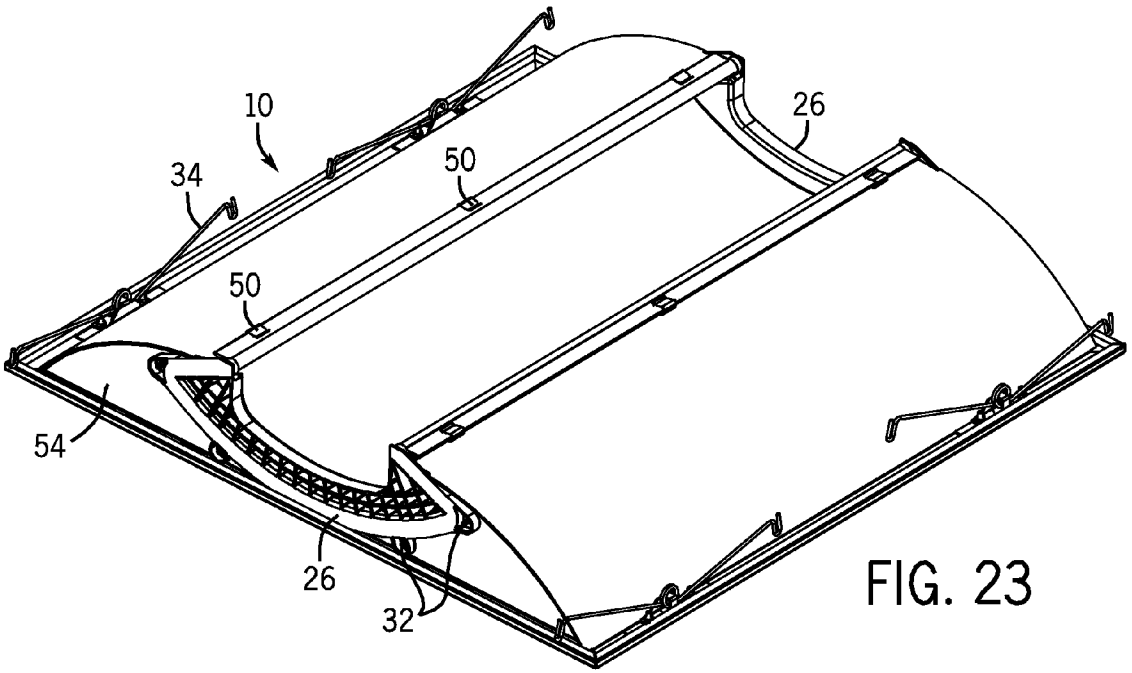
FIG. 23 is a perspective drawing of a unibody-reflector assembly of a 2×2-foot embodiment of the inventive luminaire.
Figure 23B:
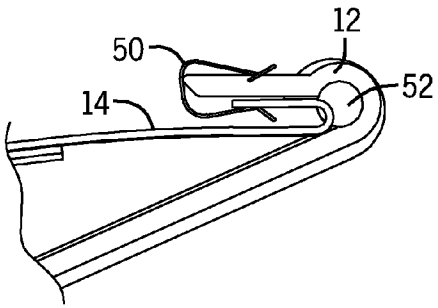
FIG. 23B is a detailed drawing of the indicated region A of FIG. 23A, showing an assembled clip, lens, cord gasket and reflector in detail.
Figure 23A:
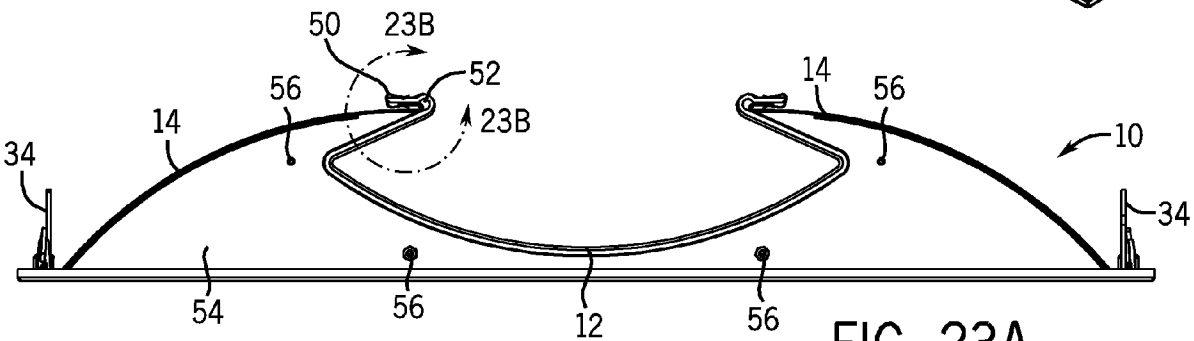
FIG. 23A is a endview elevation of the unibody-reflector assembly of FIG. 23, shown with the endcap removed.

FIG. 23 is a perspective drawing of a 2×2-foot embodiment of the sealed recessed lighting fixture incorporating the unibody-reflector assembly. In an embodiment of the sealed recessed lighting fixture utilizing ferrous materials, the reflectors, distal edge and endwalls may be made of sheet steel and assembled using the continuous-seam-welded process. Clips 50 are included to secure lens 12 to reflector 14. In addition, gasket 52 is positioned between t lens 12 and reflector 14 to further seal lens 12 to reflector 14. Endwall 54 includes several apertures 56 for securing endcap 26 thereto.

Figure 13:
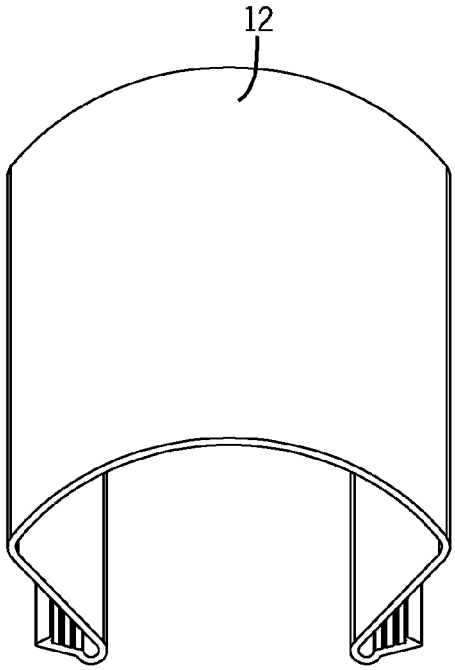
FIGS. 13-15 are three photographs of a section of a diffuser lens showing the configuration of such diffuser lens. The luminaire of the embodiment of FIG. 1 incorporates a clear lens and an inner perforated diffuser layer inside the lens while the diffuser lens of FIGS. 13-15 uses a translucent diffusing material for the lens.
Figure 14:
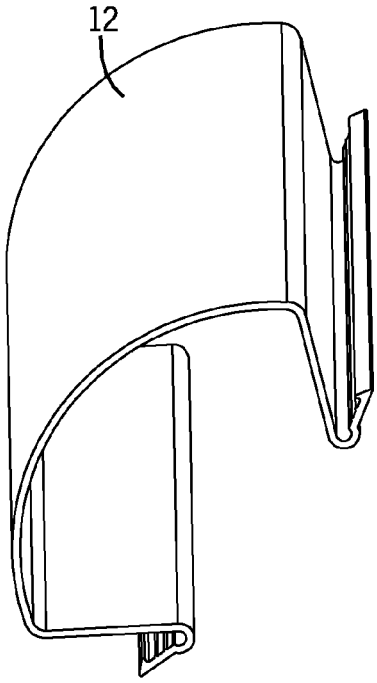
Figure 15:
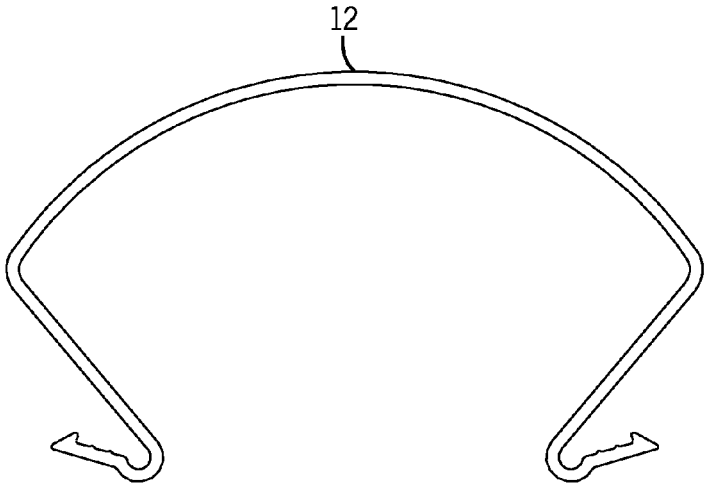
Figure 24:
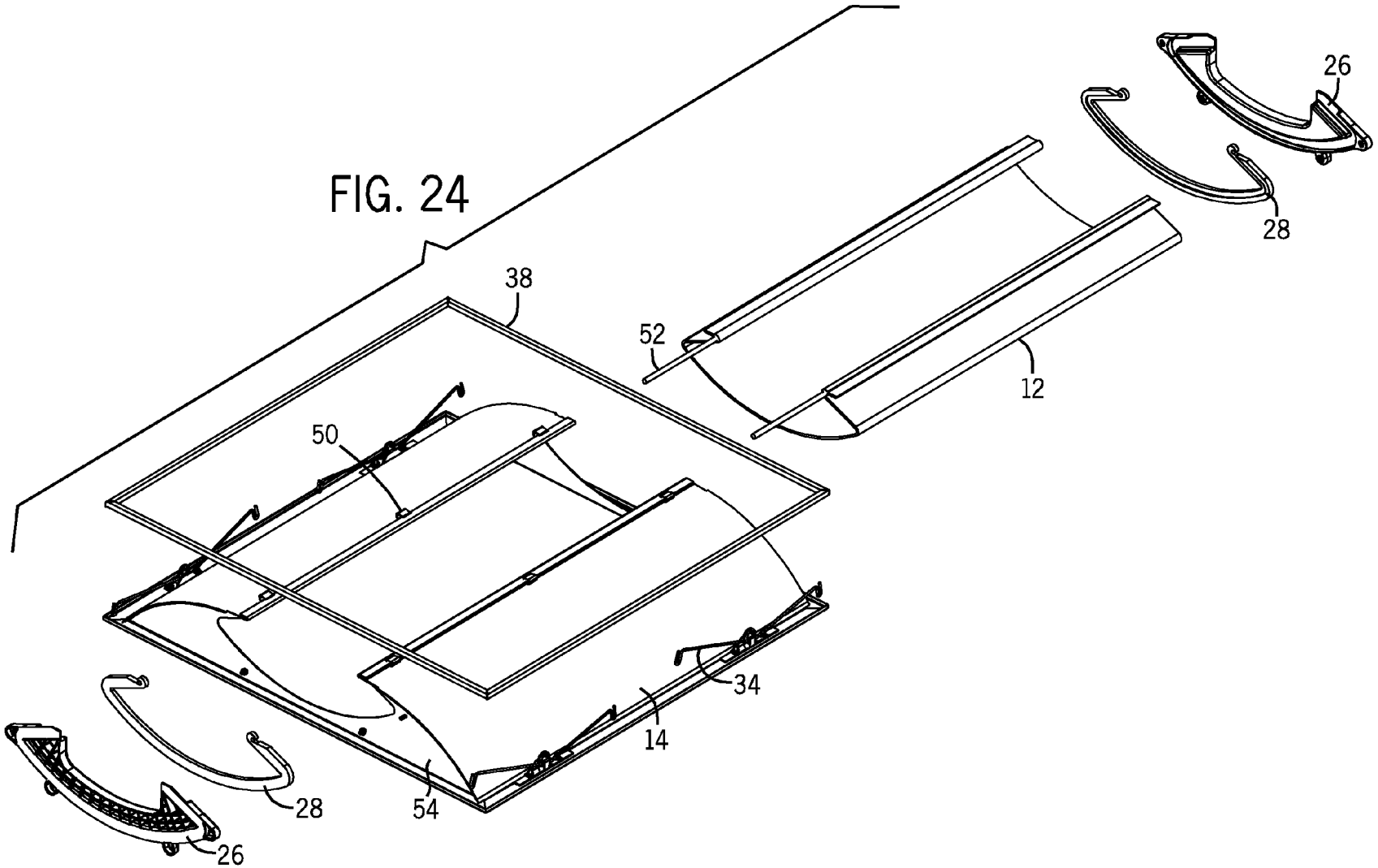
FIG. 24 is an exploded perspective drawing of the unibody-reflector assembly of FIG. 23.
Figure 25:
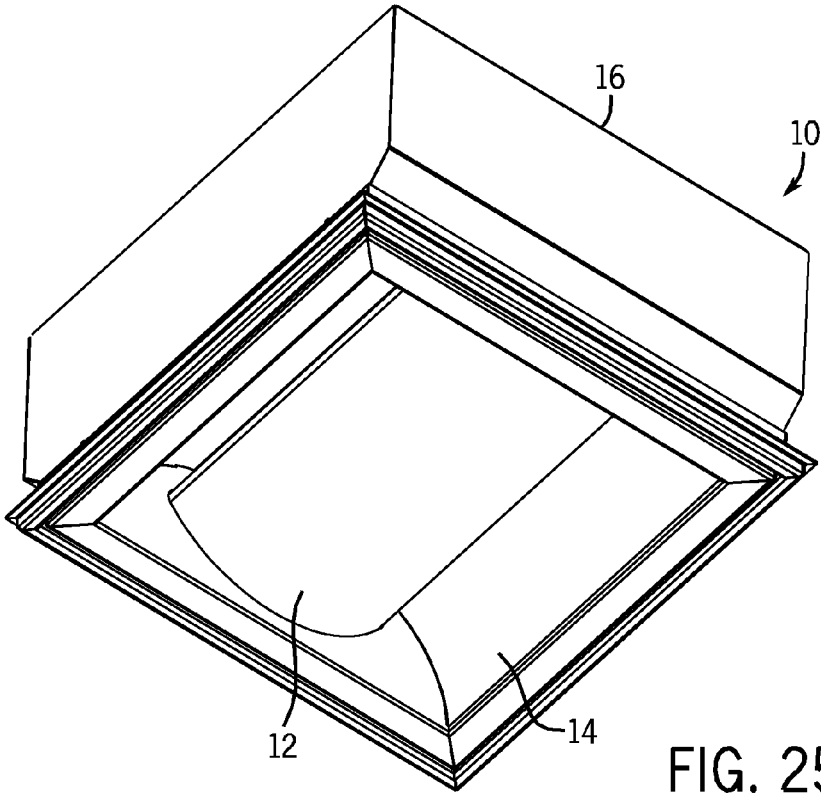
FIG. 25 is a photograph of a fully-assembled 1×1-foot unibody-reflector luminaire.
Figure 26:
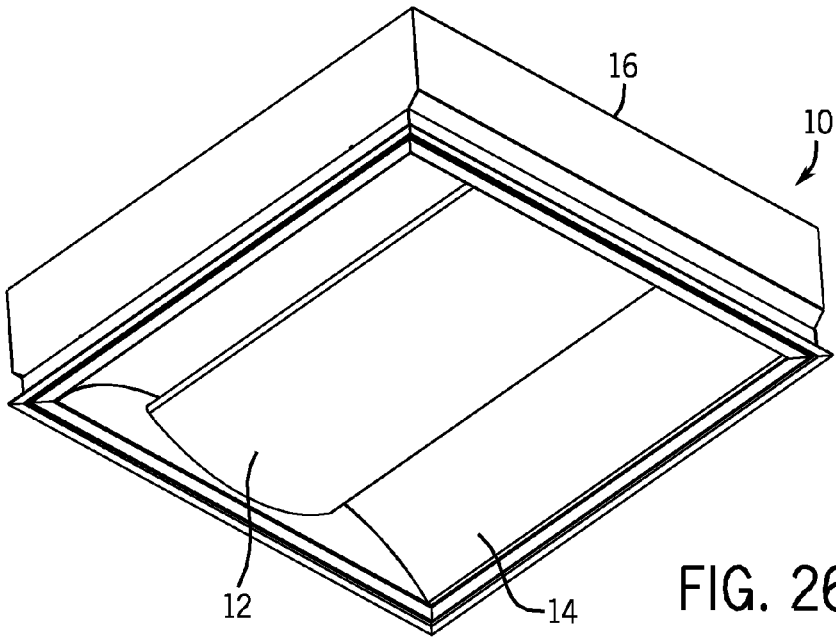
FIG. 26 is a photograph of a fully-assembled 2×2-foot unibody-reflector luminaire.
Figure 27:
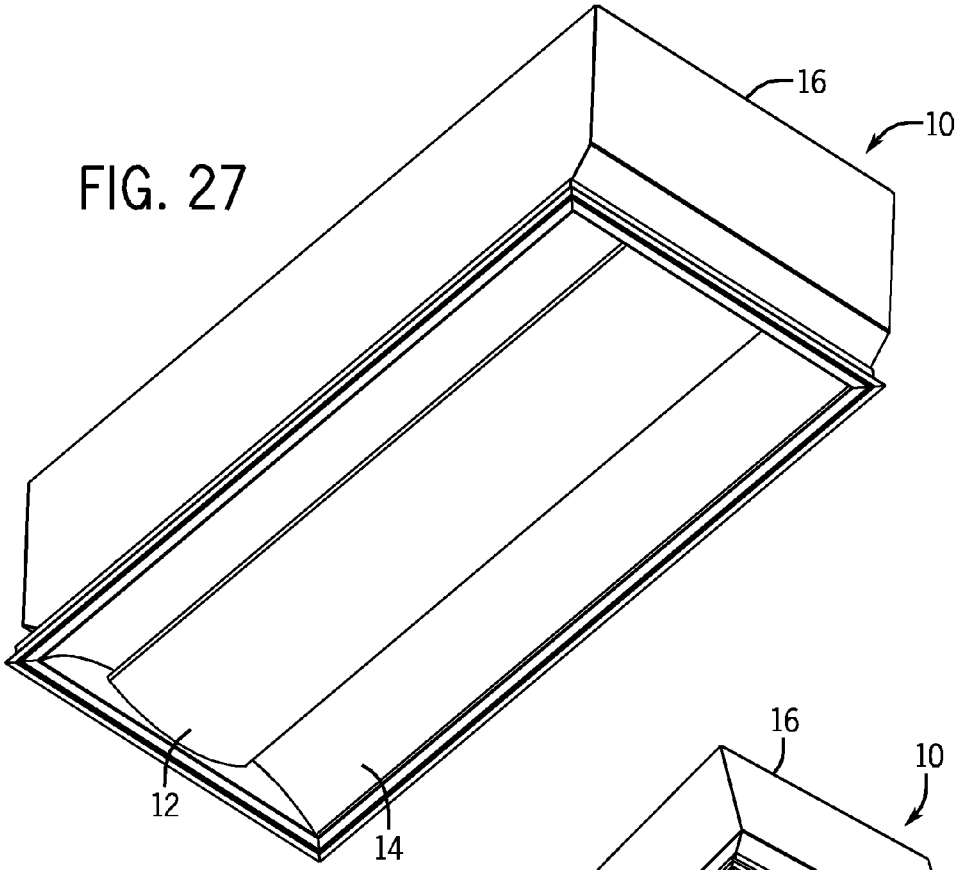
FIG. 27 is a photograph of a fully-assembled 1×2-foot unibody-reflector luminaire.
Figure 28:
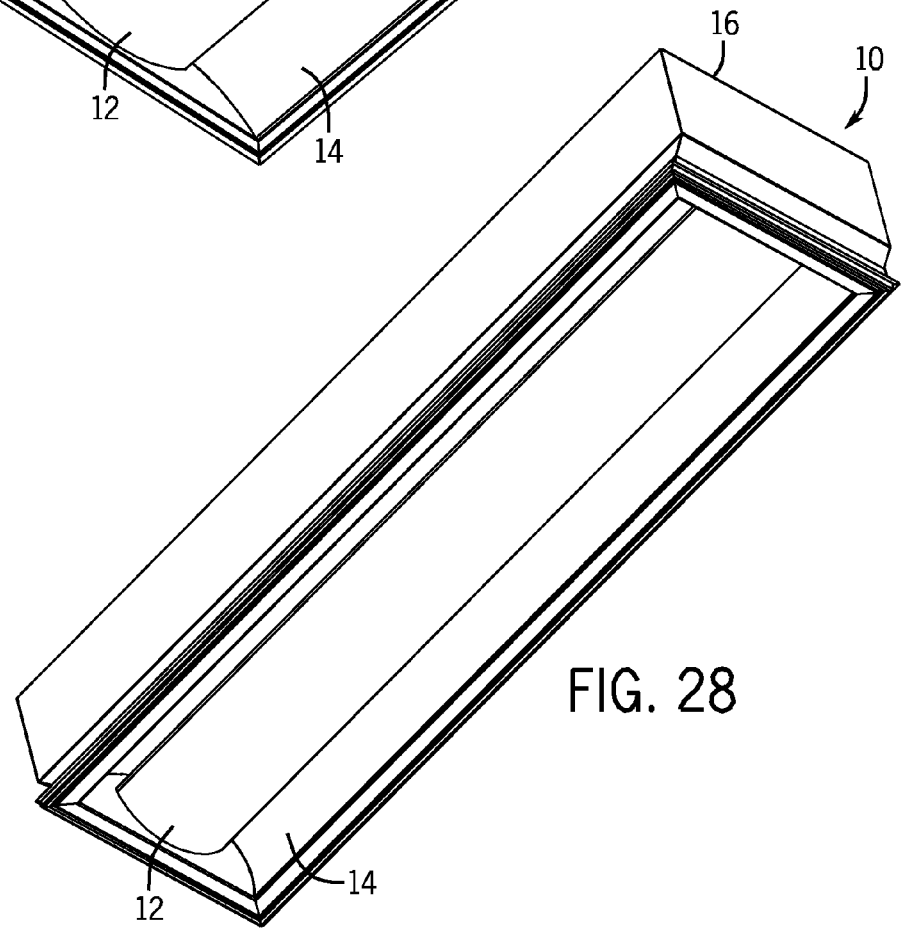
FIG. 28 is a photograph of a fully-assembled 1×4-foot unibody-reflector luminaire.

FIG. 24 is an exploded perspective drawing of the unibody-reflector assembly of FIG. 23. Lens 12 may be of any clear or translucent polymer material having good light-transmissive characteristics. The lens may be made by an extrusion process. FIGS. 13-15 show a short section of diffusing lens 12 which is made of translucent polymer material. The luminaire shown in FIGS. 1-8, 17, and 25 includes a clear polymer lens 12 with a perforated diffuser element installed behind the lens. The lighting fixtures shown in FIGS. 20 and 26-28 include a translucent polymer lens 12.

Reference throughout this specification to "the embodiment," "this embodiment," "the previous embodiment," "one embodiment," "an embodiment," "a preferred embodiment" "another preferred embodiment" or similar language means that a particular feature, structure, or characteristic described in connection with the embodiment is included in at least one embodiment of the present invention. Thus, appearances of the phrases "in the embodiment," "in this embodiment," "in the previous embodiment," "in one embodiment," "in an embodiment," "in a preferred embodiment," "in another preferred embodiment," and similar language throughout this specification may, but do not necessarily, all refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

While the present invention has been described in connection with certain exemplary or specific embodiments, it is to be understood that the invention is not limited to the disclosed embodiments, but, on the contrary, is intended to cover various modifications, alternatives, modifications and equivalent arrangements as will be apparent to those skilled in the art. Any such changes, modifications, alternatives, modifications, equivalents and the like may be made without departing from the spirit and scope of the invention.

The invention claimed is:

1. In a sealed recessed lighting fixture having a housing forming a ceiling-alignment plane and a light-emitting opening, at least one elongate lamp mounted to and within the housing and defining a fixture direction, at least one reflector surface parallel to the fixture direction, and a lens, the improvement wherein the at least one reflector surface is/are part(s) of a unibody-reflector assembly which includes: (a) two reflector sections terminating in longitudinal inner edges forming a gap therebetween; (b) a distal edge perimetrically along the light-emitting opening of the housing; (c) a seal between the distal edge and the housing at the opening; (d) two opposed substantially parallel endwalls each having a lens-engaging proximal edge; (e) the lens being an elongate shaped member terminating at opposite lens ends, the lens enveloping the at least one lamp and being of substantially constant cross-section along its length, whereby the unibody-reflector assembly is removable from the housing as a single unit to expose the lamp(s) in the housing for service.

2. The recessed lighting fixture of claim 1 further including a pair of endcaps each engaged with a respective one of the endwalls, each lens end being in sealed engagement with a respective one of the endcaps.

3. The recessed lighting fixture of claim 2 wherein each lens end extends beyond a corresponding endwall.

4. The recessed lighting fixture of claim 1 wherein the proximal lens-engaging edges are complementary to the lens cross-section.

5. The recessed lighting fixture of claim 1 wherein the lens has an arcuate light-transmissive central portion facing the light-emitting opening and two longitudinal edge portions each in sealing engagement with a respective reflector section inner edge.

6. The recessed lighting fixture of claim 1 wherein the lens has an arcuate light-transmissive central portion facing the light-emitting opening, two inwardly-turned light-transmissive side portions therealong, and two longitudinal edge portions each in sealing engagement with a respective reflector section inner edge.

7. The recessed lighting fixture of claim 6 wherein the at least one lamp is a fluorescent tube substantially centered along the gap.

8. The recessed lighting fixture of claim 6 wherein the at least one lamp is a plurality of fluorescent tubes.

9. In a sealed recessed lighting fixture having a housing forming a ceiling-alignment plane and a light-emitting opening, at least one lamp mounted to and within the housing, at least one reflector surface of substantially constant cross-section along its length which defines a fixture direction, and a lens, the improvement wherein the at least one reflector surface is/are part(s) of a unibody-reflector assembly which includes: (a) two reflector sections terminating in longitudinal inner edges forming a gap therebetween; (b) a distal edge perimetrically along the light-emitting opening of the housing; (c) a seal between the distal edge and the housing at the opening; (d) two opposed substantially parallel endwalls each having a lens-engaging proximal edge; (e) the lens being an elongate shaped member terminating at opposite lens ends, the lens enveloping the at least one lamp and being of substantially constant cross-section along its length, whereby the unibody-reflector assembly is removable from the housing as a single unit to expose the lamp(s) in the housing for service.

10. The recessed lighting fixture of claim 9 further including a pair of endcaps each engaged with a respective one of the endwalls, each lens end being in sealed engagement with a respective one of the endcaps.

11. The recessed lighting fixture of claim 10 wherein each lens end extends beyond a corresponding endwall.

12. The recessed lighting fixture of claim 9 wherein the proximal lens-engaging edges are complementary to the lens cross-section.

13. The recessed lighting fixture of claim 9 wherein the lens has an arcuate light-transmissive central portion facing the light-emitting opening, two inwardly-turned light-transmissive side portions therealong, and two longitudinal edge portions each in sealing engagement with a respective reflector section inner edge.

14. The recessed lighting fixture of claim 9 wherein the at least one lamp comprises at least one LED module.

15. The recessed lighting fixture of claim 9 wherein the at least one lamp is an elongate lamp parallel to the fixture direction.

16. The recessed lighting fixture of claim 15 wherein the at least one lamp is a fluorescent tube.

17. The recessed lighting fixture of claim 15 wherein the at least one lamp is a plurality of fluorescent tubes.

* * * * *